US005911101A

United States Patent [19]

Park

[11] Patent Number: 5,911,101

[45] Date of Patent: Jun. 8, 1999

[54] PHOTORECEPTOR BELT CLEANING APPARATUS OF LIQUID ELECTROPHOTOGRAPHIC PRINTER

[75] Inventor: Gyeong-ho Park, Suwon, Rep. of Korea

[73] Assignee: Samsung Electronics Co., Ltd., Kyungki-do, Rep. of Korea

[21] Appl. No.: 09/088,483

[22] Filed: Jun. 2, 1998

[30] Foreign Application Priority Data

Aug. 27, 1997 [KR] Rep. of Korea ..... 97-41639

[51] Int. Cl.[6] ..... G03G 15/00; G03G 21/00

[52] U.S. Cl. ..... 399/345; 399/71; 399/352; 399/348

[58] Field of Search ..... 399/34, 71, 345, 399/350, 351, 352, 353, 354

[56] References Cited

U.S. PATENT DOCUMENTS 5,797,063 8/1998 Umezawa et al. ..... 399/34

*Primary Examiner*—Arthur T. Grimley
*Assistant Examiner*—Hoang Ngo
*Attorney, Agent, or Firm*—Sughrue, Mion, Zinn, Macpeak & Seas, PLLC

[57] ABSTRACT

A photoreceptor belt cleaning apparatus of a liquid electrophotographic printer for removing a residual developer liquid and foreign matter remaining on a photoreceptor belt used as a photoreceptor medium. The apparatus includes a housing elevatably installed by a reciprocating means provided in a printer body for moving the housing towards or away from the photoreceptor belt, and a traveling cleaning belt supported by a plurality of rollers rotatably installed in the housing. While the cleaning belt travels selectively in contact with the surface of the photoreceptor belt, the surface of the photoreceptor belt can be cleaned.

11 Claims, 5 Drawing Sheets

PHOTORECEPTOR BELT CLEANING APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to a photoreceptor belt cleaning apparatus for removing residual developer liquid and foreign matter remaining on a photoreceptor belt which is used as a photoreceptor medium.

2. Description of the Related Art

In general, in an electrophotographic printer, an electrostatic latent image formed on a photoreceptor medium such as a photoreceptor drum or a photoreceptor belt is developed using developer liquid having a toner mixed with a volatile liquid carrier and transferred to a sheet, thereby printing a desired image.

Referring to FIG. 1 schematically showing a conventional liquid electrophotographic color printer, a photoreceptor belt 110 circulates about a plurality of rollers 121, 122 and 123 which support the photoreceptor belt 110. The surface of the photoreceptor belt 110 is charged to a predetermined level by a charging station 150. Then, an electrostatic latent image is formed in the photoreceptor belt 110 by a laser scanning unit 130 for irradiating a laser beam onto the photoreceptor belt 11 according to image signals. The electrostatic latent image is developed by a development station 140 for supplying developer liquid. As shown in FIG. 1, in the case of a color printer, a plurality of laser scanning units 130 and a plurality of development stations 140 corresponding to various colors are provided.

As shown in FIG. 2, each of the development stations 140 includes a development roller 141, a cleaning roller 142 and squeegee rollers 144 and 146 directly under the photoreceptor belt 110. Additionally, the development stations each contains a developer liquid 148 in which a toner having a predetermined color and a liquid carrier are mixed. Reference numeral 143 represents a developer liquid supplier for supplying the developer liquid 148 between the development roller 141 and the photoreceptor belt 110.

The squeegee rollers 144 and 146 remove the residual developer liquid 148 after the developer liquid 148 is utilized for developing the electrostatic latent image. The removed developer liquid is withdrawn into the development station 140 by blades 145 and 147.

The liquid carrier contained in the developer liquid 148 sticking to the electrostatic latent image of the photoreceptor belt 110 is evaporated while passing the image drying station 160 so that only the toner remains on the photoreceptor belt 110 thereby completing the process for producing a developed image 148D.

Subsequently, the developed image 148D is transferred to a sheet 126 which is fed between a transfer roller 124 and a fixing roller 125 via the transfer roller 124, to then be printed. Thereafter, an electrostatic charge remaining in the photoreceptor belt 110 is removed by an erasure station 170.

Here, after the developed image 148D of the photoreceptor belt 110 is transferred to the sheet 126, the toner must be completely removed from the photoreceptor belt 110. However, if the developed image 148D is not completely transferred to the transfer roller 124, some toner sludge may remain on the photoreceptor belt 110. Also, foreign matter in the printer may stick to the photoreceptor belt 110 while the photoreceptor belt 110 circulates. The residual toner or foreign matter sticking to the photoreceptor belt 110 causes poor quality development in repetitive printing procedures, thereby adversely affecting the printing quality of a printed image.

SUMMARY OF THE INVENTION

To solve the above problem, it is an objective of the present invention to provide a photoreceptor belt cleaning apparatus for removing toner sludge or contaminants sticking to the surface of a photoreceptor belt.

Accordingly, to achieve the above objective, there is provided a photoreceptor belt cleaning apparatus of a liquid electrophotographic printer comprising: a photoreceptor belt circulating around belt supporting rollers which are rotatably installed in a printer body; a housing installed to advance or retreat to/from the photoreceptor belt; a plurality of rotation rollers rotatably installed in the housing; a cleaning belt supported by the plurality of rotation rollers, traveling and selectively being in contact with the surface of the photoreceptor belt as the housing advances or retreats; and a reciprocating means for driving the housing to advance or retreat to/from the photoreceptor belt.

The reciprocating means comprises: an actuator installed in the printer body, for advancing the housing to the photoreceptor belt; and an elastic member for elastically biasing the housing to be spaced apart from the photoreceptor belt.

Alternatively, the reciprocating means comprises: an elastic member for elastically biasing the housing to be spaced apart from the photoreceptor belt; a driving motor installed in the printer body; a cam provided on the output shaft of the driving motor; and a cam follower installed in the housing to be in contact with the cam for reciprocating the housing with respect to the photoreceptor belt by a cam movement.

Also, the plurality of rotation rollers comprise: a driven roller around which a first end of the cleaning belt is wound; a driving roller rotated by a driving source and around which a second end of the cleaning belt is wound; and a support roller installed between the driving roller and the driven roller for supporting the cleaning belt to be in contact with the surface of the photoreceptor belt.

According to another aspect of the present invention, the plurality of rotation rollers further comprise: a backup roller facing the support roller, with the photoreceptor belt interposed therebetween, for supporting the photoreceptor belt.

According to still another aspect of the present invention, the plurality of rotation rollers comprise: a pair of driven rollers around which ends of the cleaning belt is wound and supported, respectively; a power transmitting unit for selectively rotating one of the pair of driven rollers for causing the cleaning belt to travel in the same direction as or opposite direction to the photoreceptor belt; and a support roller installed between the driven rollers for supporting the cleaning belt to be in contact with the surface of the photoreceptor belt.

Here, the power transmitting unit comprises: driven gears each installed in the driven rollers; a driving motor having a driving gear coupled to the driving motor's output shaft; a rotary lever installed to rotate around the output shaft; an idle gear rotatably installed at one end of the rotary lever to be selectively in mesh with one of the driven gears according to the rotation of the rotary lever; and an actuator rotating the rotary lever.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
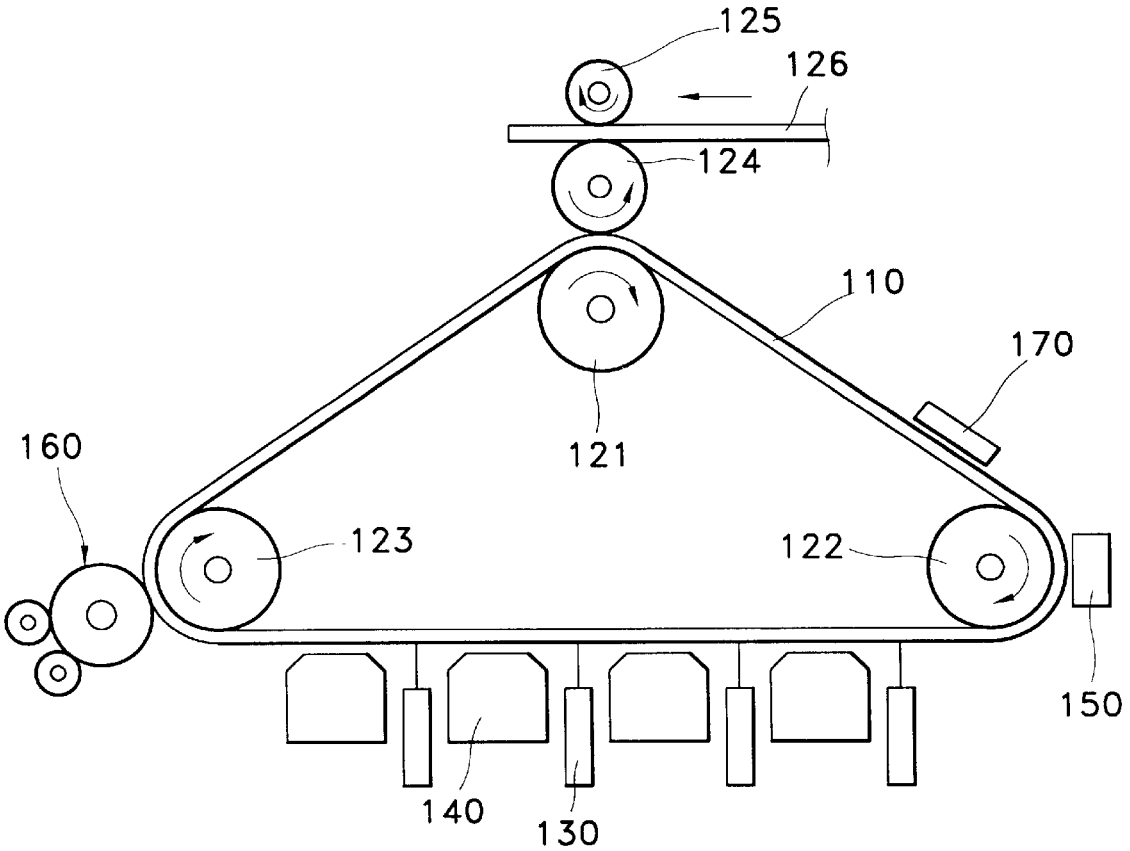
FIG. 1(PRIOR ART)
FIG. 1 is a schematic diagram of a conventional liquid electrophotographic printer.
Figure 2:
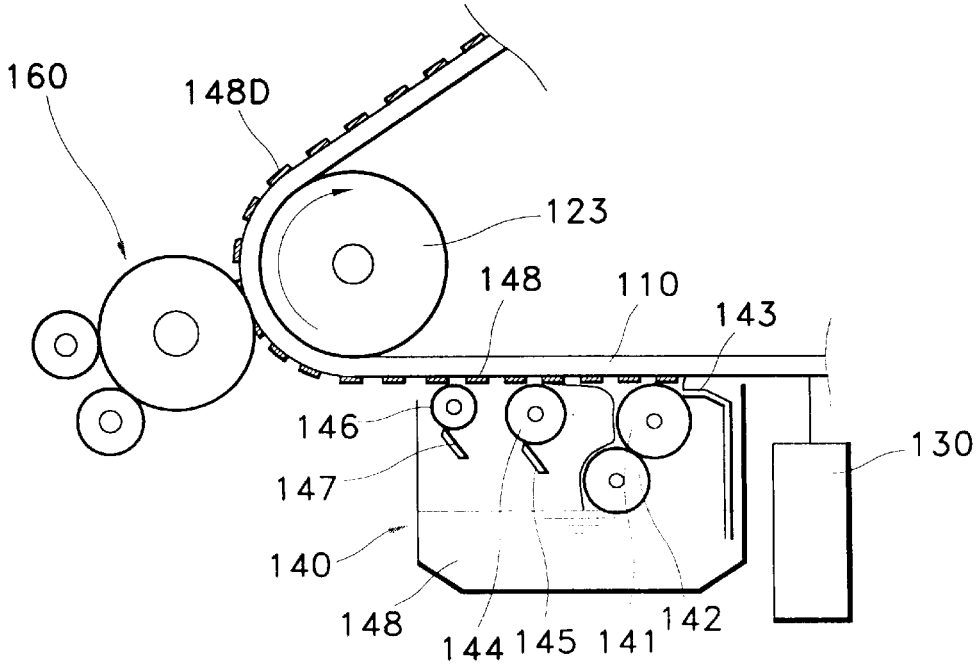
FIG. 2(PRIOR ART)
FIG. 2 is a schematic diagram showing a development station shown in FIG. 1.
Figure 3:
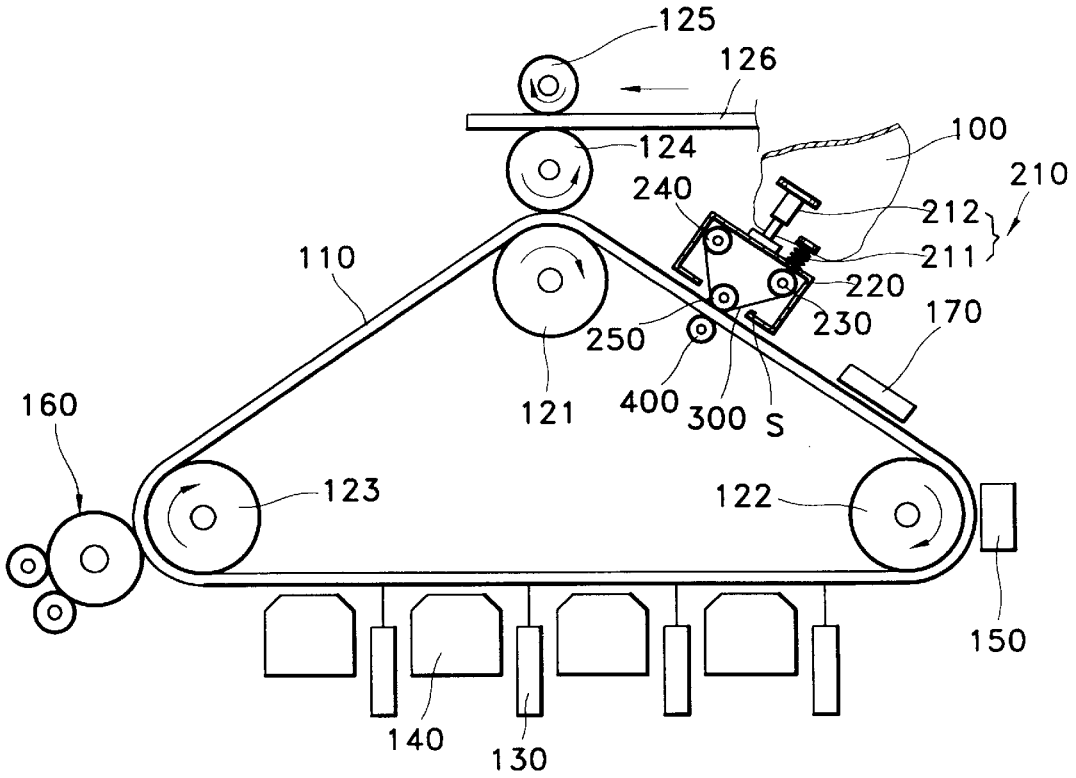
FIG. 3 is a schematic diagram of a liquid electrophotographic printer having a photoreceptor belt cleaning apparatus according to a first embodiment of the present invention.
Figure 4:
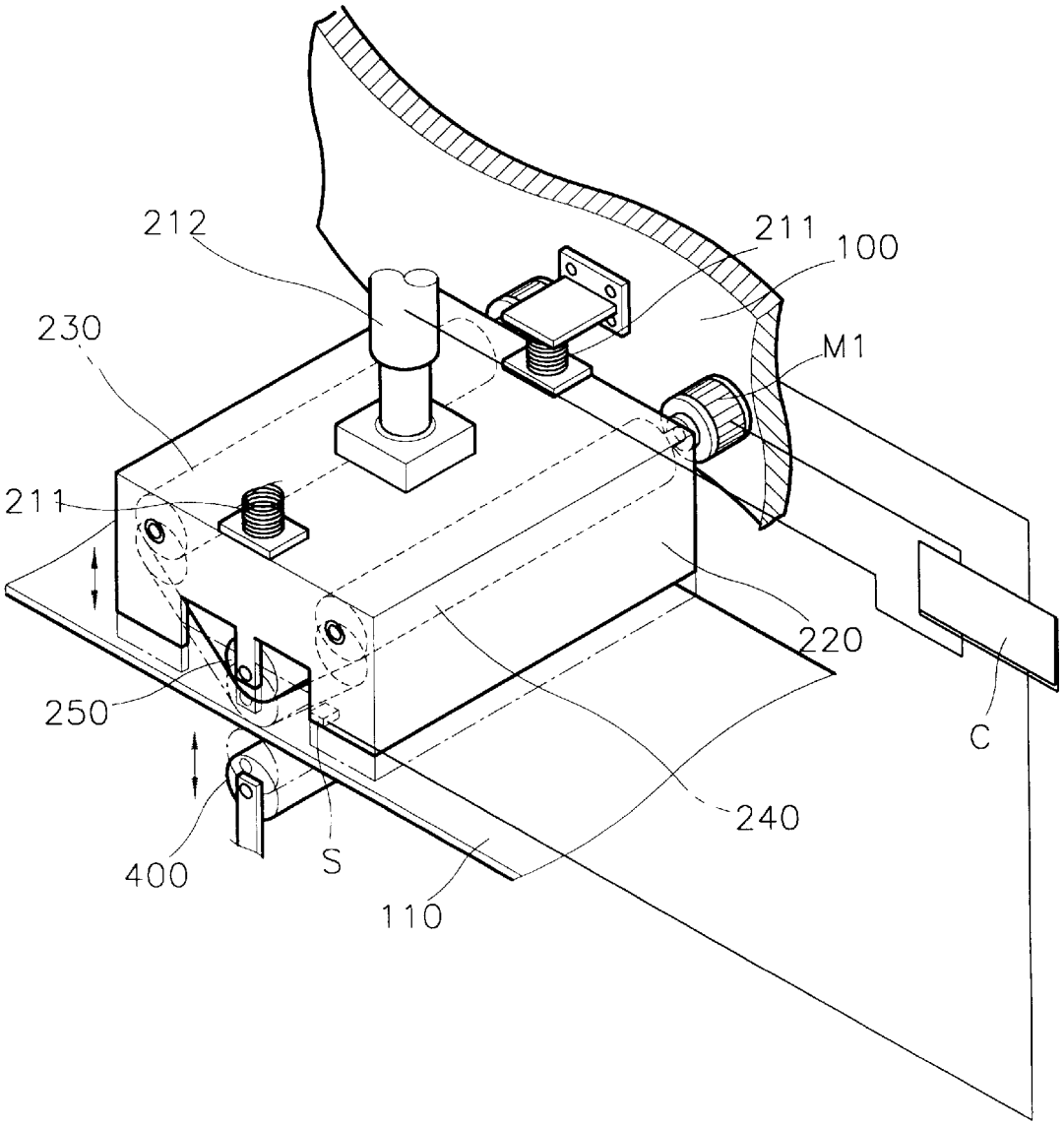
FIG. 4 is a schematic perspective view illustrating the photoreceptor belt cleaning apparatus shown in FIG. 3.

Referring to FIGS. 3 and 4, a photoreceptor belt cleaning apparatus of a liquid electrophotographic apparatus according to a first embodiment of the present invention will be described in detail. Here, the same reference numerals as those shown above represent the same elements.

The photoreceptor belt cleaning apparatus according to this embodiment, as shown in FIGS. 3 and 4, includes a housing 220 installed to move backward and forward from/to the photoreceptor belt 110 by a reciprocating means 210 installed in a printer body 100, a plurality of rotation rollers 230, 240 and 250 rotatably installed in the housing 220, and a cleaning belt 300 mounted on the rotation rollers 230, 240 and 250 and traveling in the same direction as the photoreceptor belt 110.

The cleaning belt 300, in order to perform a cleaning operation, selectively comes into contact with the surface of the photoreceptor belt 110 as the housing 220 advances and retreats to/from the photoreceptor belt 110.

The reciprocating means 210, as shown in FIG. 4, includes an elastic member 211, such as a torsion spring, coupled to the printer body 100 and the housing 220 for elastically biasing the housing 220 toward the photoreceptor belt 110, and an actuator 212 for retracting the housing 220 from the photoreceptor belt 110. Alternatively, the elastic member can be designed so as to elastically bias the housing 220 away from the photoreceptor belt 110, and the actuator 212 can be use to selectively move the housing 220 towards the photoreceptor belt 110.

In the case of using a solenoid as the actuator 212, the housing 220 progresses toward the photoreceptor belt 110 by the driving force of the solenoid. If the driving force of the solenoid is eliminated, the housing 220 returns to its original place by the restoring force of the elastic member 211. In the case of using a cylinder as the actuator 212, since the housing 220 can be reciprocated in both directions by the cylinder, the elastic member 211 is not necessary.

Also, the actuator 212 is connected to a controller (C) connected to a control panel (not shown) and can be controlled by manipulating the control panel.

The rotation rollers include a driven roller 230 on which one end of the cleaning belt 300 is wound, a driving roller 240 driven by a driving motor (M1) provided in the housing 220 for winding the other end of the cleaning belt 300, and a support roller 250 positioned between the driven roller 230 and driving roller 240 for supporting the cleaning belt 300 to be in contact with the surface of the photoreceptor belt 110.

A pair of the support rollers 250 may be installed to increase the contact area between the cleaning belt 300 and the photoreceptor belt 110.

The driving motor M1 is connected to the controller C so as to be controlled by manipulating the control panel.

Here, reference character S represents a sensor for detecting an end mark (not shown) indicated at one end of the cleaning belt 300, and is installed in the housing 220 to be connected to the controller C. Thus, when the sensor S detects the end mark and transmits the detected signal to the controller C, the controller C controls the driving roller 240 to stop the traveling of the cleaning belt 300.

Here, reference numeral 400 represents a backup roller installed to face the support roller 250 with the photoreceptor belt 110 interposed therebetween. The backup roller 400 selectively contacts the photoreceptor belt 110.

The photoreceptor belt cleaning apparatus of a liquid electrophotographic printer having the aforementioned configuration according to the present invention carries out the cleaning of the photoreceptor belt by the following operation.

For example, if a cleaning switch (not shown) of the control panel (not shown) provided in the printer body 100 is turned on by an operator, the controller C drives the reciprocating means 210 to move the housing 220 toward the photoreceptor belt 110. Thus, the cleaning belt 300 supported by the support roller 250 comes into contact with the surface of the photoreceptor belt 110. Simultaneously, the backup roller 400 advances to the photoreceptor belt 110 so as to confront the support roller 250 with the photoreceptor belt 110 supported therebetween.

Also, the driving roller 240 is driven to draw the cleaning belt 300 from the driven roller 230. Therefore, while the cleaning belt 300 travels in the same direction as the photoreceptor belt 110, the cleaning belt 300 cleans the surface of the photoreceptor belt 110.

If the cleaning of the photoreceptor 110 is completed, the sensor S detects the end mark indicated at the end of the cleaning belt 300 and transmits a detected signal. Then, the controller C controls the driving of the driving roller 240 so that the traveling of the cleaning belt 300 is terminated.

Subsequently, the controller C controls the reciprocating means 210 to move the housing 220 backward from the photoreceptor belt 110 for separating the cleaning belt 300 from the photoreceptor belt 110. At this time, the photoreceptor belt 110 is also stopped from traveling by the controller C.

According to the present invention, the driven roller 230 is detachably installed in the housing 220 so as to be replaced with another driven roller on which a new cleaning belt (or cleaning roll) is wound after the cleaning belt 300 is used up.

Alternatively, after the traveling of the cleaning belt 300 is completed, a rewind switch (not shown) of the control panel can be manipulated to rotate the driven roller 230 in the reverse direction by a separate driving motor connected to the controller C, thereby rewinding the cleaning belt 300 to its original state. In this case, another end mark provided at the other end of the cleaning belt 300 is detected by the sensor S and the signal corresponding thereto is transmitted to the controller C which stops the rewinding operation of the cleaning belt 300. Thus, the cleaning belt 300 can be used for more than one cycle.

Also, the photoreceptor belt cleaning apparatus of a liquid electrophotographic printer according to the present invention can be periodically driven according to a predetermined traveling distance of the photoreceptor belt 110. In other words, the traveling distance of the photoreceptor belt 110 is known by detecting an end mark (not shown) indicated on the photoreceptor belt 110 using a separate sensor (not shown) installed in the printer body 100. When the traveling distance of the photoreceptor belt 110 reaches a predetermined level, the housing 220 is driven by the controller C so that the cleaning operation of the cleaning belt 300 can be performed repeatedly.

Figure 5:
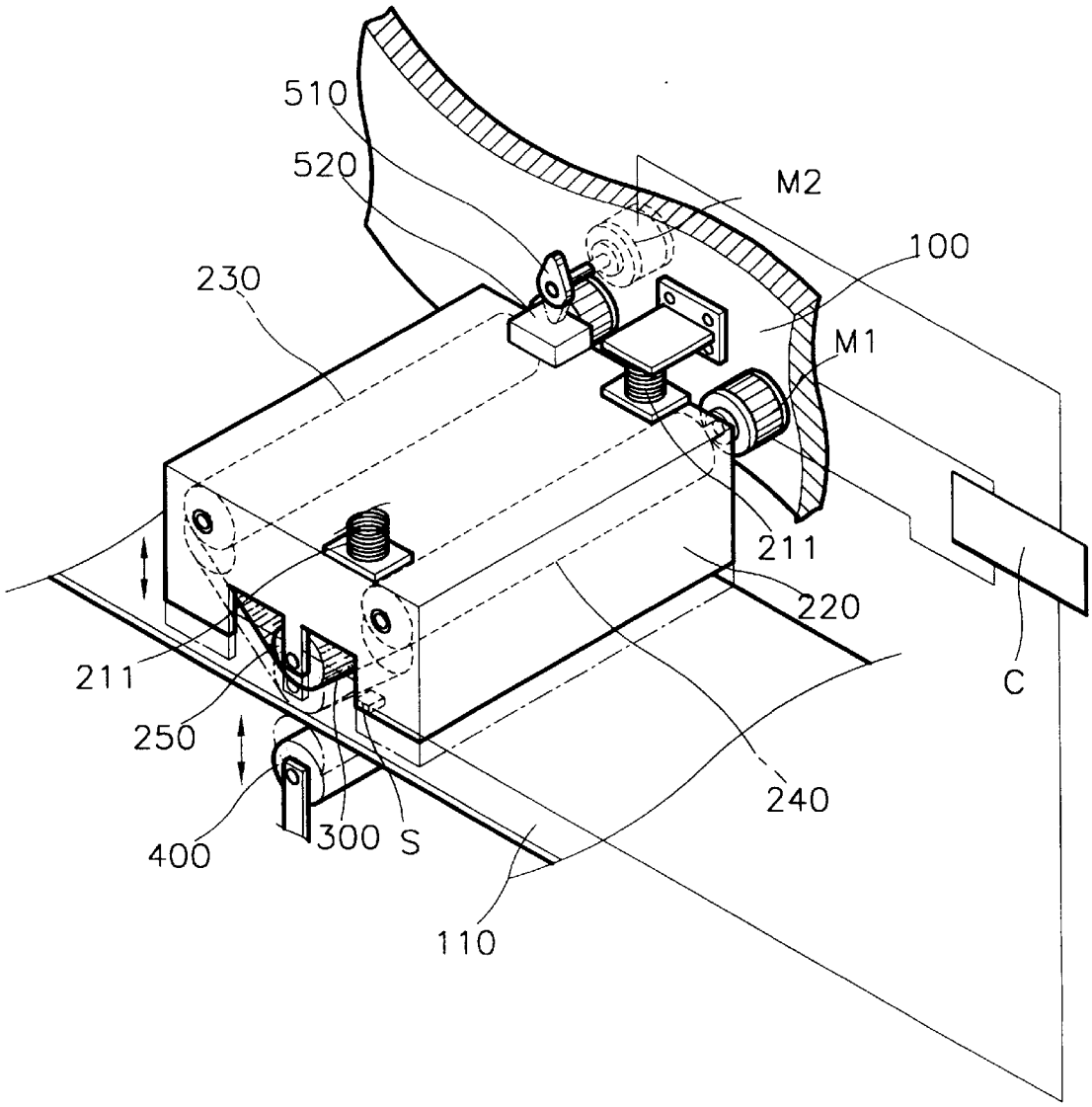
FIG. 5 is a schematic perspective view illustrating a photoreceptor belt cleaning apparatus according to a second embodiment of the present invention.

FIG. 5 illustrates a photoreceptor belt cleaning apparatus according to a second embodiment of the present invention. Here, the same reference numerals as those of the first embodiment represent the same elements. According to this embodiment, a reciprocating means includes a cam 510 coupled to the output shaft of a driving motor (M2) installed in the printer body 100, and a cam follower 520 installed on the housing 220 in contact with the cam 510.

The housing 220 reciprocates with respect to the photoreceptor belt 110 by the movement of the cam 510 and the cam follower 520. The driving motor M2 is preferably driven stepwise. According to the rotation of the cam 510 by the driving motor M2, if the longer radial part of the cam 510 contacts the cam follower 520, the housing 220 advances to the photoreceptor belt 110. If the shorter radial part of the cam 510 contacts the cam follower 520, the housing 220 retreats from the photoreceptor belt 110 by the recovery force of the elastic member 211.

Figure 6:
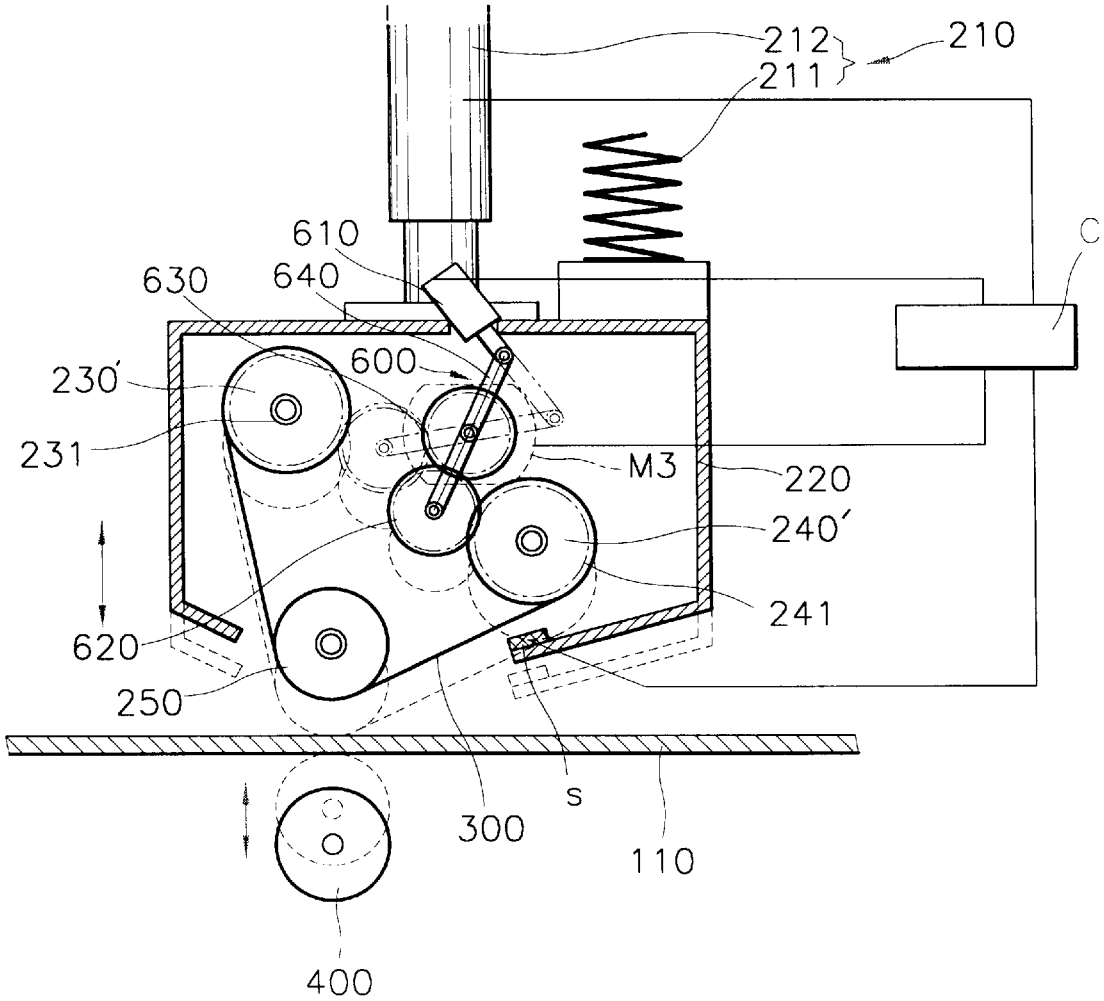
FIG. 6 is a schematic perspective view illustrating a photoreceptor belt cleaning apparatus according to a third embodiment of the present invention.

FIG. 6 is a schematic perspective view illustrating a photoreceptor belt cleaning apparatus according to a third embodiment of the present invention. Here, again, the same reference numerals as those of the first and second embodiment of the present invention represent the same elements.

As shown in FIG. 6, the photoreceptor belt cleaning apparatus according to this embodiment includes first and second driven rollers 230' and 240' on which ends of the cleaning belt 300 are wound, respectively, and a support roller 250 installed between the first and second driven rollers 230' and 240' for supporting the cleaning belt 300 against the photoreceptor belt 110.

The first and second driven rollers 230' and 240' are selectively rotated in a clockwise or counter clockwise direction by a power transmitting unit 600 having a driving motor M3 provided in the housing 220 and an actuator 610 connected to the controller C.

The power transmitting unit 600 includes first and second driven gears 231 and 241 provided on a side of the first and second driven rollers 230' and 240', respectively, a driving gear 630 coupled to the output shaft of the driving motor M3, a rotary lever 640 rotatably installed between the first and second driven rollers 230' and 240' around the rotation shaft of the driving gear 630 so as to selectively drive the first and second driven gears 231 and 241, and an idle gear 620 rotatably installed at a first end of the rotary lever 640, and which is continuously in mesh with the driving gear 630 and selectively in mesh with the first and second driven gears 231 and 241 for selectively transmitting power to these gears.

The rotary lever 640 rotates by the driving of the actuator 610 connected to its second end.

According to the above-described configuration, the cleaning belt 300 contacts with the surface of the photoreceptor belt 110, indicated by the dotted lines, as the housing 220 advances. The housing 220 moves in the same manner as described in the first or second embodiments. In a state where the cleaning belt 300 is in contact with the photoreceptor belt 110, if the driving motor M3 is driven by the controller C, the rotational force of the driving motor M3 is transferred to the second driven gear 241 through the driving gear 630 and the idle gear 620 to rotate the second driven roller 240'. Thus, the cleaning belt 300 cleans the surface of the photoreceptor belt 110 while it is wound from the first driven roller 230' into the second driven roller 240'.

If the cleaning operation is completed, the sensor S detects the end mark indicated at one end of the cleaning belt 300, and transmits the detected signal to the controller C, so that the controller C controls the reciprocating means 210 to retreat the housing 220 for separating the cleaning belt 300 apart from the photoreceptor belt 110.

Subsequently, the controller C drives the actuator 610 to rotate the rotary lever 64°. In this case, the idle gear 620 revolves around the driving gear 630 toe in mesh with the first driven gear 231. Therefore, the cleaning belt 300 wound around the second driven roller 240 travels in the reverse direction by the rotation of the first driven gear 231 to be, thereby, rewound around the first driven roller 230'. Therefore, the cleaning belt 300 can be used repeatedly.

As described above, in the photoreceptor belt cleaning apparatus of a liquid electrophotographic printer, during a printing operation, the residual developer liquid or contaminant sticking to the surface of a traveling photoreceptor belt can be cleaned by a cleaning belt on a real time basis, thereby improving printing quality. Also, rewinding or replacement of the cleaning belt can be performed quickly and easily.

What is claimed is:

1. A photoreceptor belt cleaning apparatus for a liquid electrophotographic printer comprising:

a printer body;

belt rollers rotatably installed in said printer body;

a photoreceptor belt supported by said belt rollers so that said photoreceptor belt can be circulated around said belt rollers;

a housing movably disposed in said printer body so that said housing can be moved towards and away from said photoreceptor belt;

a plurality of rotation rollers rotatably installed in said housing;

a cleaning belt supported by said plurality of rotation rollers so that said cleaning belt can travel around said rotation rollers, said cleaning belt coming into contact with a surface of said photoreceptor belt as said housing is moved towards said photoreceptor belt; and a reciprocating means for driving the housing towards and away from said photoreceptor belt.

2. The photoreceptor belt cleaning apparatus according to claim 1, wherein said reciprocating means comprises:

an actuator installed in said printer body for moving said housing towards said photoreceptor belt; and an elastic member for elastically biasing said housing to be spaced apart from said photoreceptor belt.

3. The photoreceptor belt cleaning apparatus according to claim 1, wherein said reciprocating means comprises:

an elastic member for elastically biasing said housing to be spaced apart from said photoreceptor belt;

a driving motor installed in said printer body;

a cam provided on an output shaft of said driving motor; and a cam follower installed on said housing to be in contact with said cam for reciprocating said housing towards and away from said photoreceptor belt by a cam movement.

4. The photoreceptor belt cleaning apparatus according to claim 1, wherein said plurality of rotation rollers comprise:

a driven roller around which a first end of said cleaning belt is wound;

a driving roller around which a second end of said cleaning belt is wound, said driving roller being driven by a driving source; and a support roller installed between said driving roller and said driven roller for supporting said cleaning belt so that said cleaning belt comes into contact with the surface of said photoreceptor belt when said housing is moved towards said photoreceptor belt.

5. The photoreceptor belt cleaning apparatus according to claim 4, further comprising:

a backup roller, facing said support roller with said photoreceptor belt interposed therebetween, for supporting the photoreceptor belt against said support roller at least during a cleaning operation.

6. The photoreceptor belt cleaning apparatus according to claim 1, wherein said plurality of rotation rollers comprise:

a pair of driving rollers around which ends of the cleaning belt is wound and supported, respectively, for selectively causing said cleaning belt to travel in at least one of a same direction as and an opposite direction to a circulating movement of said photoreceptor belt;

driving motors for transmitting a rotational force to said respective driving rollers; and a support roller installed between said driving rollers for supporting said cleaning belt so that said cleaning belt comes into contact with the surface of said photoreceptor belt when said housing is moved towards said photoreceptor belt.

7. The photoreceptor belt cleaning apparatus according to claim 6, wherein said cleaning belt travels in the same direction as the circulating movement of said photoreceptor belt when said cleaning belt contacts the photoreceptor belt, and wherein said cleaning belt travels in the opposite direction to the circulating movement of said photoreceptor belt when said cleaning belt is spaced apart from said photoreceptor belt.

8. The photoreceptor belt cleaning apparatus according to claim 1, wherein said plurality of rotation rollers comprise:

a pair of driven rollers around which ends of the cleaning belt is wound and supported, respectively;

a power transmitting unit for selectively rotating one of said pair of driven rollers for causing said cleaning belt to travel in one of a same direction as and an opposite direction to a circulating movement of said photoreceptor belt; and a support roller installed between said driven rollers for supporting said cleaning belt so that said cleaning belt comes into contact with the surface of said photoreceptor belt when said housing is moved towards said photoreceptor belt.

9. The photoreceptor belt cleaning apparatus according to claim 8, wherein said power transmitting unit comprises;

driven gears each coupled to said respective driven rollers;

a driving motor having a driving gear coupled to an output shaft of said driving motor;

a rotary lever installed so as to be rotatable about said output shaft;

an idle gear rotatably installed to one end of said rotary lever so as to be selectively in mesh with one of said driven gears according to the rotation of said rotary lever; and an actuator for rotating said rotary lever.

10. The photoreceptor belt cleaning apparatus according to claim 1, further comprising:

a sensor for detecting an end mark indicated at one end of said cleaning belt and for outputting a detected signal in response to a detection of the end mark; and a controller for controlling said driving roller to be driven according to the signal output from said sensor.

11. The photoreceptor belt cleaning apparatus according to claim 1, wherein said reciprocating means comprises:

an actuator installed in said printer body for moving said housing away from said photoreceptor belt; and an elastic member for elastically biasing said housing towards said photoreceptor belt.

* * * * *